US010978822B2

(12) United States Patent
Hoshino et al.

(10) Patent No.: US 10,978,822 B2
(45) Date of Patent: Apr. 13, 2021

(54) CONNECTOR

(71) Applicant: OMRON Corporation, Kyoto (JP)

(72) Inventors: Hirokazu Hoshino, Okayama (JP); Taijiro Fujiwara, Okayama (JP); Masato Matoba, Okayama (JP); Masaki Nakamura, Kyoto (JP); Masaru Higuchi, Okayama (JP); Hiroshi Okuyama, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 16/640,728

(22) PCT Filed: Nov. 2, 2018

(86) PCT No.: PCT/JP2018/040863

§ 371 (c)(1),
(2) Date: Feb. 21, 2020

(87) PCT Pub. No.: WO2019/107072

PCT Pub. Date: Jun. 6, 2019

(65) Prior Publication Data

US 2020/0176921 A1 Jun. 4, 2020

(30) Foreign Application Priority Data

Nov. 29, 2017 (JP) ..... JP2017-229605

(51) Int. Cl.
*H01R 13/52* (2006.01)
*H01B 7/02* (2006.01)
*H01R 13/504* (2006.01)

(52) U.S. Cl.
CPC ..... *H01R 13/5205* (2013.01); *H01B 7/02* (2013.01); *H01R 13/504* (2013.01)

(58) Field of Classification Search
CPC ..... H01R 13/5205; H01R 13/504; H01R 13/5845; H01R 13/533; H01R 31/06
See application file for complete search history.

(56) References Cited

U.S. PATENT DOCUMENTS 1,862,947 A * 6/1932 Smith ..... B29C 48/15 264/171.14
6,074,240 A 6/2000 Bradshaw et al.
(Continued)

FOREIGN PATENT DOCUMENTS

CN 103069659 A 4/2013
CN 206364274 U 7/2017
(Continued)

OTHER PUBLICATIONS

An English translation of the International Search Report("ISR") of PCT/JP2018/040863 dated Dec. 11, 2018.
(Continued)

*Primary Examiner* — Jean F Duverne
(74) *Attorney, Agent, or Firm* — Metrolex IP Law Group, PLLC

(57) ABSTRACT

A connector is provided with a cable that includes a conductor and an insulation, connector bodies that are provided on one ends in an extending direction of the cable, and a cover unit that covers and integrates each of the one ends of the cable and each of the connector bodies. The cable includes a first cohesion unit provided on a surface of the insulation at each of one ends over an entire circumference around the extending direction of the cable, and fixed to the cover unit so as to be detachable by cohesive fracture.

4 Claims, 5 Drawing Sheets

(56) References Cited

U.S. PATENT DOCUMENTS

| | | | | |
|---|---|---|---|---|
| 7,511,222 | B2 * | 3/2009 | Taylor | H02G 15/1826 174/84 R |
| 7,641,494 | B2 * | 1/2010 | Chen | H01R 13/625 439/275 |
| 8,328,578 | B2 * | 12/2012 | Csak | H01R 13/405 439/606 |
| 8,822,826 | B2 * | 9/2014 | Onodi | H01R 12/67 174/117 FF |
| 9,819,120 | B2 * | 11/2017 | Mukuno | H01R 13/533 |
| 10,553,990 | B2 * | 2/2020 | Grimm | H01R 43/24 |
| 2011/0159731 | A1 * | 6/2011 | Kataoka | B60R 16/0207 439/604 |
| 2013/0118804 | A1 * | 5/2013 | Liegl | H01R 4/18 174/84 C |
| 2013/0140056 | A1 | 6/2013 | Adachi et al. | |

FOREIGN PATENT DOCUMENTS

| | | | |
|---|---|---|---|
| JP | H08-055649 | A | 2/1996 |
| JP | 5722570 | B2 | 5/2015 |
| JP | 2016-126981 | A | 7/2016 |
| TW | M492552 | U | 12/2014 |
| TW | M496870 | U | 3/2015 |

OTHER PUBLICATIONS

The Written Opinion("WO") of PCT/JP2018/040863 dated Dec. 11, 2018.

The Taiwanese Office Action dated May 31, 2019 in a counterpart Taiwanese patent application.

The Office Action (CNOA) dated Sep. 15, 2020 in a counterpart Chinese patent application.

* cited by examiner

CONNECTOR

TECHNICAL HELD

The present disclosure relates to a connector.

BACKGROUND ART

Patent Document 1 discloses a connector including: a connector body on the inside of which a contact pin is housed; a cord having one end connected to the contact pin; and a body covering the circumference surface of the connector body and the cord.

PRIOR ART DOCUMENT

Patent Document

Patent Document 1: JP H8-055649 A

SUMMARY OF INVENTION

Subjects to be Solved by the Invention

However, in the connector, oil resistance is not considered, and hence, for example, when the connector is used in a machine tool that uses a lot of oil such as lubricating oil, the oil may pass between the cord and the body and flow into the connector body, causing a failure such as malfunction.

An object of the present disclosure is to provide a connector having high oil resistance.

Means for Solving the Subjects

An example of a connector according to the present disclosure is provided with: a cable that includes a conductor and an insulation covering the conductor; a connector body that is provided on one end in an extending direction of the cable, and on the inside of which a terminal connected with the conductor of the cable is housed; and a cover unit that covers and integrates the one end of the cable and the connector body. The cable includes a cohesion unit provided on a surface of the insulation at the one end over the entire circumference around the extending direction of the cable, and fixed to the cover unit so as to be detachable by cohesive fracture.

Effects of the Invention

According to the connector, the cable includes a cohesion unit provided on a surface of the insulation at the one end over the entire circumference around the extending direction of the cable, and fixed to the cover unit so as to be detachable by cohesive fracture. This cohesion unit makes it possible to prevent the oil from entering the inside of the connector body through the space between the cable and the cover unit for a long time, and achieve a connector having high oil resistance.

MODES FOR CARRYING OUT THE INVENTION

Hereinafter, an example of the present disclosure will be described with reference to the accompanying drawings. In the following description, terms indicating specific directions or positions (e.g., terms including "up," "down," "right," and "left") will be used as necessary, but the use of those terms is to facilitate understanding of the present disclosure with reference to the drawings, and the technical scope of the present disclosure is not limited by the meanings of those terms. The following description is essentially mere illustration and does not intend to restrict the present disclosure, its application, or its use. Further, the drawings are schematic, and the ratio of each dimension, or the like, does not necessarily match an actual one.

Figure 1:
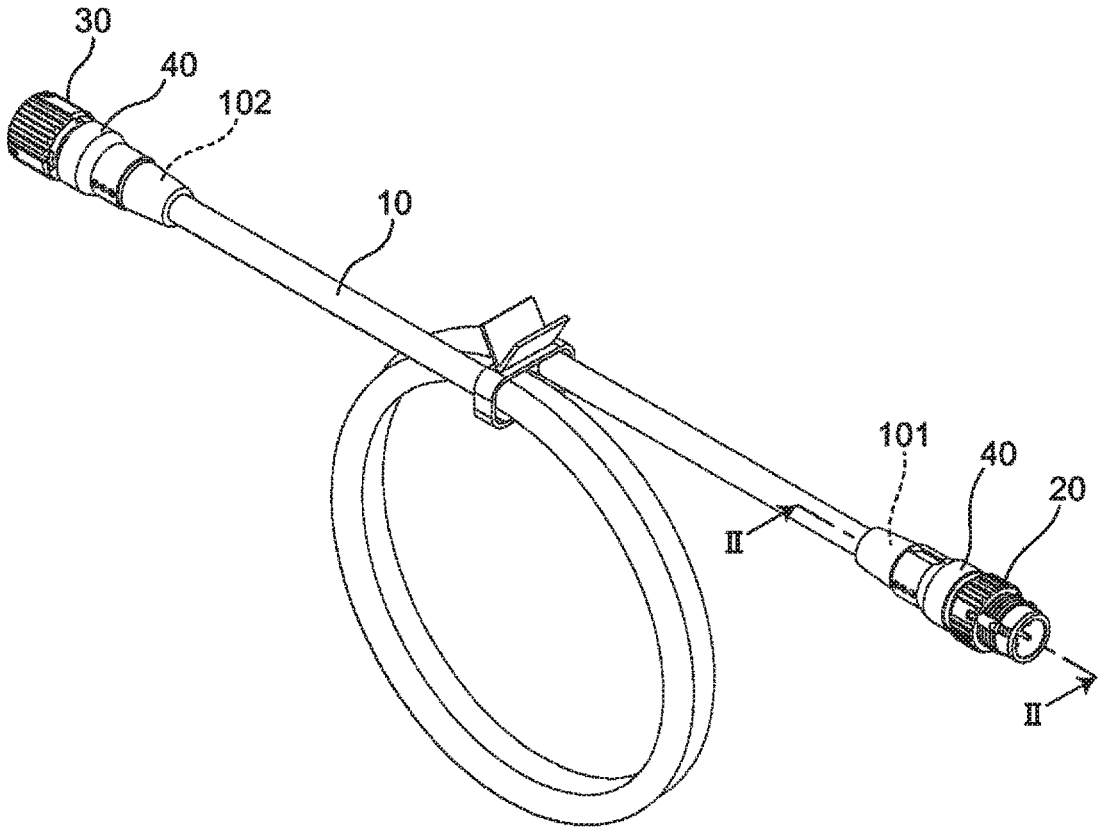
FIG. 1 is a perspective view of a connector according to an embodiment of the present disclosure.

As shown in FIG. 1, a connector 1 according to an embodiment of the present disclosure includes a cable 10, connector bodies 20, 30 each provided at one end in an extending direction of the cable 10, and a cover unit 40 that integrates the cable 10 and the connector bodies 20, 30. In this embodiment, as an example, a first connector body 20 as a plug connector and a second connector body 30 as a socket connector are provided at both ends of the cable 10 in the extending direction, respectively.

Figure 2:
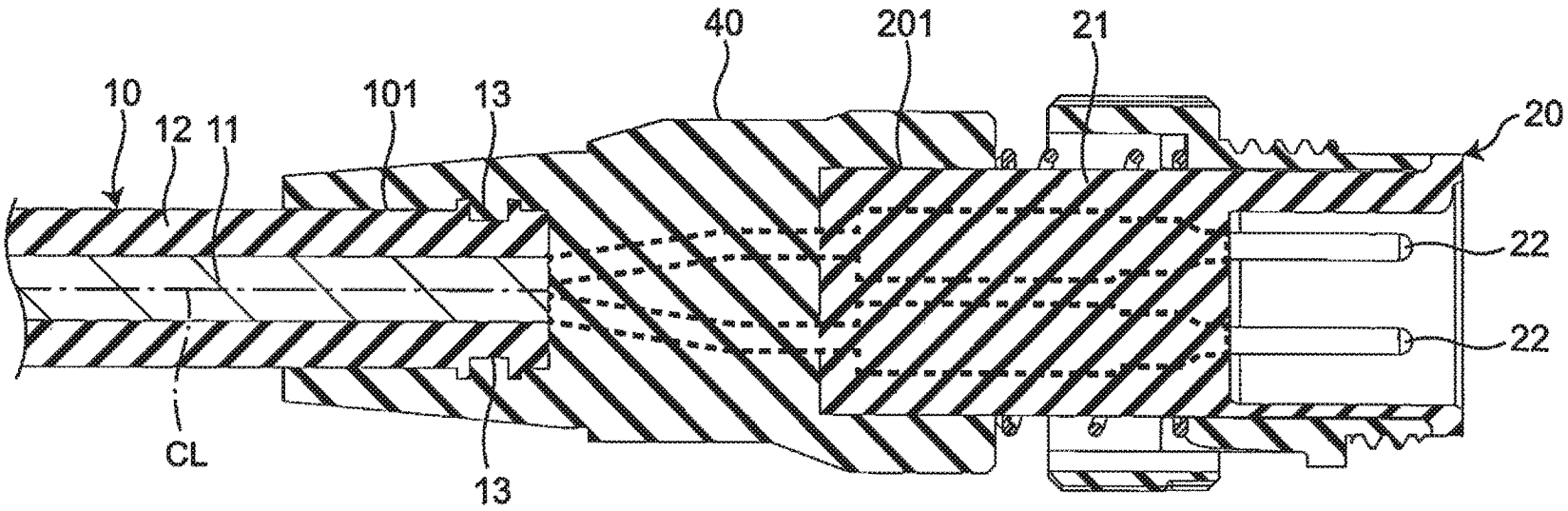
FIG. 2 is a sectional view taken along line II-II in FIG. 1.

The cable 10 has a substantially circular shape on a plane orthogonal to the extending direction thereof as shown in FIG. 1, and the cable 10 includes a conductor 11 and an insulation 12 covering the conductor 11 as shown in FIG. 2. The conductor 11 is made of a conductive metal such as copper, and the insulation 12 is made of, for example, polyvinyl chloride resin (PVC resin).

At a first end 101 of the cable 10 on the first connector body 20 side in the extending direction of the cable 10, a cohesion unit 13, fixed to the cover unit 40 is provided so as to be detachable by the cohesive fracture. The cohesion unit 13 is an example of a first cohesion unit.

Figure 3:
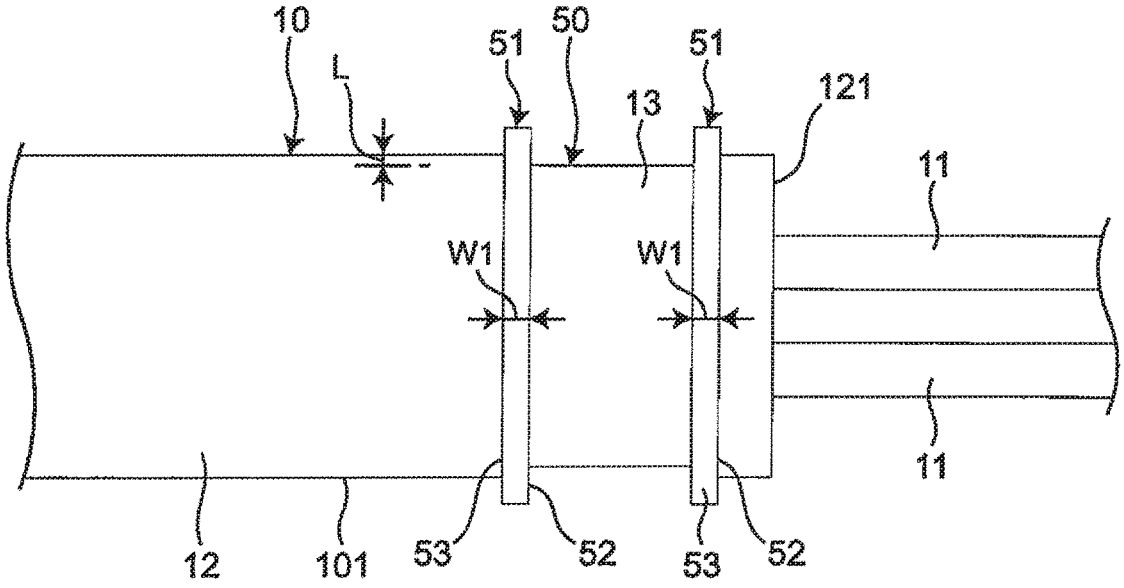
FIG. 3 is a plan view showing an end of a cable of the connector in FIG. 1.

Specifically, as shown in FIG. 3, the cohesion unit 13 is provided in the insulation 12 of the first end 101 that is one end of the cable 10, and provided on the bottom surface of a recess 50 extending over the entire circumference around the extending direction of the cable 10. That is, the cohesion unit 13 is provided on the surface of the insulation 12 at the first end 101 of the cable 10 over the entire circumference around the extending direction of the cable 10. The cohesion unit 13 is disposed apart from an end 121 on the first end 101 side of the insulation 12 of the cable 10 along the extending direction of the cable 10, in a direction away from the first connector body 20.

The cohesion unit 13 is a portion where the insulation 12 of the cable 10 and the cover unit 40 are joined, and a portion where molecules or atoms of the material of the insulation 12 or the material of the cover unit 40 are bonded by a cohesive force. In other words, the cohesion unit 13 is a portion where the insulation 12 of the cable 10 and the cover unit 40 are fixed so firmly that, when the insulation 12 of the cable 10 and the cover unit 40 are tried to be peeled off, cohesive fracture occurs in the insulation 12 of the cable 10 with respect to the cover unit 40.

In the connector 1, for example, the cohesion unit 13 is formed by forming a band-shaped recess 50 on the surface of the insulation 12 of the cable 10 over the entire circumference around the extending direction of the cable 10, and heating the bottom surface of the recess 50 at 180 to 200 degrees Celsius for 1 to 60 seconds.

In FIG. 3, the first connector body 20 and the cover unit 40 are omitted.

Further, on each side of the recess 50 in the extending direction of the cable 10, there is provided a protrusion 51 extending from the surface of the insulation 12 adjacent to the recess 50 in a direction intersecting the extending direction of the cable. The protrusion 51 extends over the entire circumference around the extending direction of the cable 10 and has a substantially rectangular annular shape on a plane orthogonal to the extending direction. A first additional cohesion unit 52 is provided on the side surface of the protrusion 51 and the recess 50, facing the first connector body 20. The first additional cohesion unit 52 is an example of a second cohesion unit.

The first additional cohesion unit 52 is provided on the side surface of the protrusion 51 facing the first connector body 20 over the entire circumference around the extending direction of the cable 10, and is fixed to the cover unit 40 so as to be detachable by cohesive fracture.

Further, similarly to the cohesion unit 13, the first additional cohesion unit 52 is a portion where the insulation 12 of the cable 10 and the cover unit 40 are joined, and a portion where molecules or atoms of the material of the insulation 12 or the material of the cover unit 40 are bonded by a cohesive force. That is, the first additional cohesion unit 52 is a portion where the insulation 12 of the cable 10 and the cover unit 40 are fixed so firmly that, when the insulation 12 of the cable 10 and the cover unit 40 are tried to be peeled off, cohesive fracture occurs in the insulation 12 of the cable 10 with respect to the cover unit 40.

Moreover, a second additional cohesion unit 53 is provided on the surface of the protrusion 51 excluding the side surface facing the first connector body 20, and on the surface excluding the bottom surface of the recess 50 and the side surface facing the first connector body 20, and is fixed to the cover unit 40 so as to be detachable by cohesive fracture. The second additional cohesion unit 53 is an example of a third cohesion unit.

Similarly to the cohesion unit 13 and the first additional cohesion unit 52, the second additional cohesion unit 53 is a portion where the insulation 12 of the cable 10 and the cover unit 40 are joined, and is a portion where molecules or atoms of the material of the insulation 12 or the material of the cover unit 40 are bonded by a cohesive force, and the insulation 12 of the cable 10 and the cover unit 40 are fixed so firmly that, when the insulation 12 of the cable 10 and the cover unit 40 are tried to be peeled off, cohesive fracture occurs in the insulation 12 of the cable 10 with respect to the cover unit 40.

Although not shown, the cohesion unit 13, the first additional cohesion unit 52, and the second additional cohesion unit 53 are also provided at a second end 102 as at the first end 101, the second end 102 being the other end of the cable 10 on the second connector body 30 side in the extending direction of the cable 10.

As shown in FIG. 2, the first connector body 20 includes an insulating housing 21 and terminals 22 (i.e., plug terminals) housed inside the housing 21 and connected to the conductor 11 of the cable 10. The first connector body 20 has a substantially cylindrical shape, and is disposed in series with the first end 101, on the first connector body 20 side in the extending direction of the cable 10, along the extending direction of a center line CL of the cable 10.

Although not shown, similarly to the first connector body 20, the second connector body 30 also includes a housing 21 and terminals 22 (i.e., socket terminals) housed inside the housing 21 and connected to the conductor 11 of the cable 10. The second connector body 30 has a substantially cylindrical shape and is disposed in series with the second end 102, on the second connector body 30 side in the extending direction of the cable 10, along the extending direction of a center line CL of the cable 10.

The cover unit 40 is made of, for example, polybutylene terephthalate resin (PBT resin), and as shown in FIG. 2, the cover unit 40 covers the first end 101 of the cable 10 and the end 201 of the first connector body 20 on the cable 10 side in the extending direction of the first connector body 20, to integrate the cable 10 and the first connector body 20.

In the connector 1, the cover unit 40 is formed by, for example, molding the PBT resin. At this time, the PBT resin is caused to flow from the first connector body 20 side toward the cable 10 side, and is cured while covering the cohesion unit 13, the first additional cohesion unit 52, and the second additional cohesion unit 53. The first additional cohesion unit 52 is disposed on an upstream surface with respect to the flow of the PBT resin when the cover unit 40 of each protrusion 51 is being molded (in other words, the side surface of the protrusion 51 facing the first connector body 20).

As shown in FIG. 1, the second connector body 30 is also integrated with the cable 10 by the cover unit 40, similarly to the first connector body 20.

In the connector 1, the cable 10 includes the cohesion unit 13 provided on the surface of the insulation 12 (i.e., the bottom surface of the recess 50) at each of the one ends 101, 102 of the cable 10 over the entire circumference around the extending direction of the cable 10. In the cohesion unit 13, the insulation 12 of the cable 10 and the cover unit 40 are fixed so firmly that, when the insulation 12 of the cable 10 and the cover unit 40 are tried to be peeled off, cohesive fracture occurs in the insulation 12 of the cable 10 with respect to the cover unit 40. The cohesion unit 13 makes it possible to prevent oil from entering the inside of each of the connector bodies 20, 30 through the space between the cable 10 and the cover unit 40 for a long time, and achieve the connector 1 having high oil resistance.

The cable 10 includes the first additional cohesion unit 52 provided on a surface facing each of the connector bodies 20, 30 and extending in the direction intersecting the extending direction of the cable 10, and is fixed to the cover unit 40 so as to be detachable by cohesive fracture. The first additional cohesion unit 52 makes it possible to prevent oil from entering the inside of each of the connector bodies 20, 30 through the space between the cable 10 and the cover unit 40 for a longer time, and achieve the connector 1 having higher oil resistance.

The cable 10 includes the protrusion 51 extending from the surface of the insulation 12, adjacent to the cohesion unit 13 in the extending direction of the cable 10, in the direction intersecting the extending direction of the cable 10. The protrusion 51 includes the first additional cohesion unit 52 disposed on the side surface of the protrusion 51 facing the connector body 20, and the second additional cohesion unit 53 provided on the surface excluding the side surface of the protrusion 51 facing the connector body 20, and fixed to the cover unit 40 so as to be detachable by cohesive fracture. By providing the protrusion 51 that includes the first additional cohesion unit 52 and the second additional cohesion unit 53, it is possible to prevent oil from entering the inside of each of the connector bodies 20, 30 through the space between the cable 10 and the cover unit 40 for a longer time, and achieve the connector 1 having higher oil resistance.

Further, the cohesion unit 13 is disposed apart from the end 121 of the insulation 12 at each of the one ends 101, 102 of the cable 10 along the extending direction of the cable 10 from each of the connector bodies 20, 30. Thereby, regardless of the cutting accuracy at the end 121 of the insulation 12 of the cable 10, the cohesion unit 13, the first additional cohesion unit 52, and the second additional cohesion unit 53 can be accurately disposed at desired positions.

Figure 4:
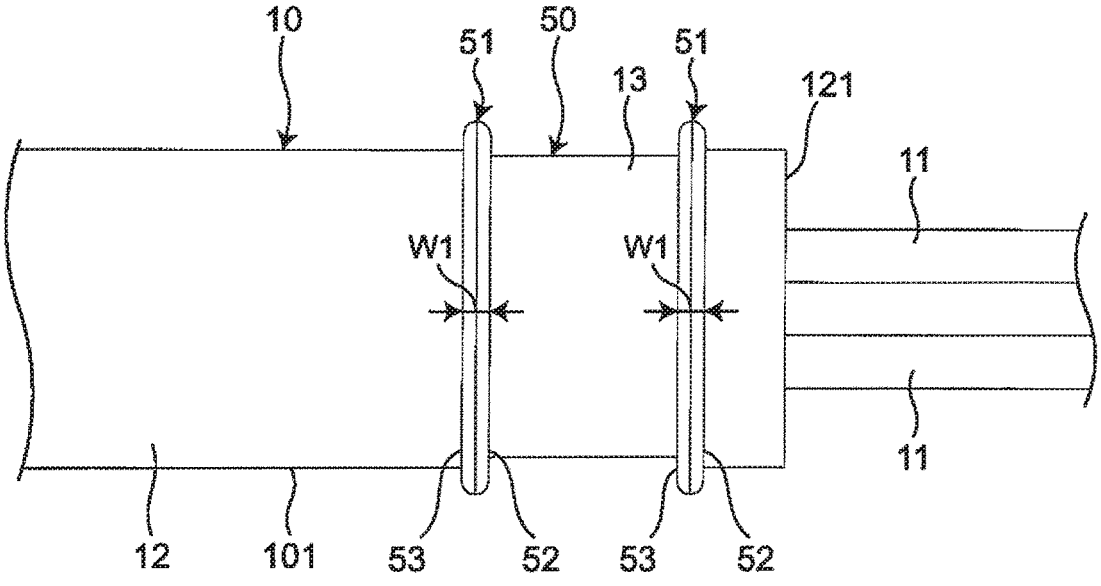
FIG. 4 is a plan view showing the end of the cable for explaining a first modification of the connector in FIG. 1.

Note that the protrusion 51 is not limited to the case where the protrusion 51 has a substantially rectangular annular shape on a plane orthogonal to the extending direction. For example, as shown in FIG. 4, the protrusion 51 may have an annular shape in which the tip apart from the cable 10 in a direction orthogonal to the extending direction of the cable 10 (in other words, the tip of the protrusion 51 on the outer side in the radial direction of the cable 10) is curved.

Figure 5:
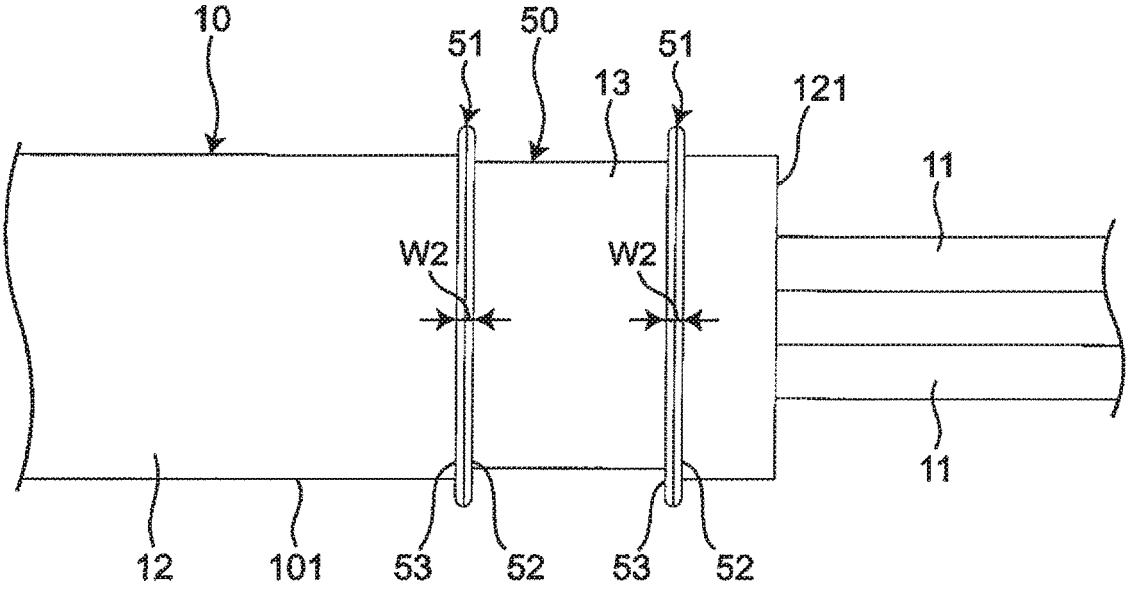
FIG. 5 is a plan view showing the end of the cable for explaining a second modification of the connector in FIG. 1.

Further, the width of the protrusion 51 (i.e., the length in the extending direction of the cable 10) can be changed in a freely selectable manner. For example, as shown in FIG. 5, the protrusion 51 may be configured to have a width W2 smaller than a width W1 of the protrusion 51 shown in FIGS. 3 and 4.

Figure 6:
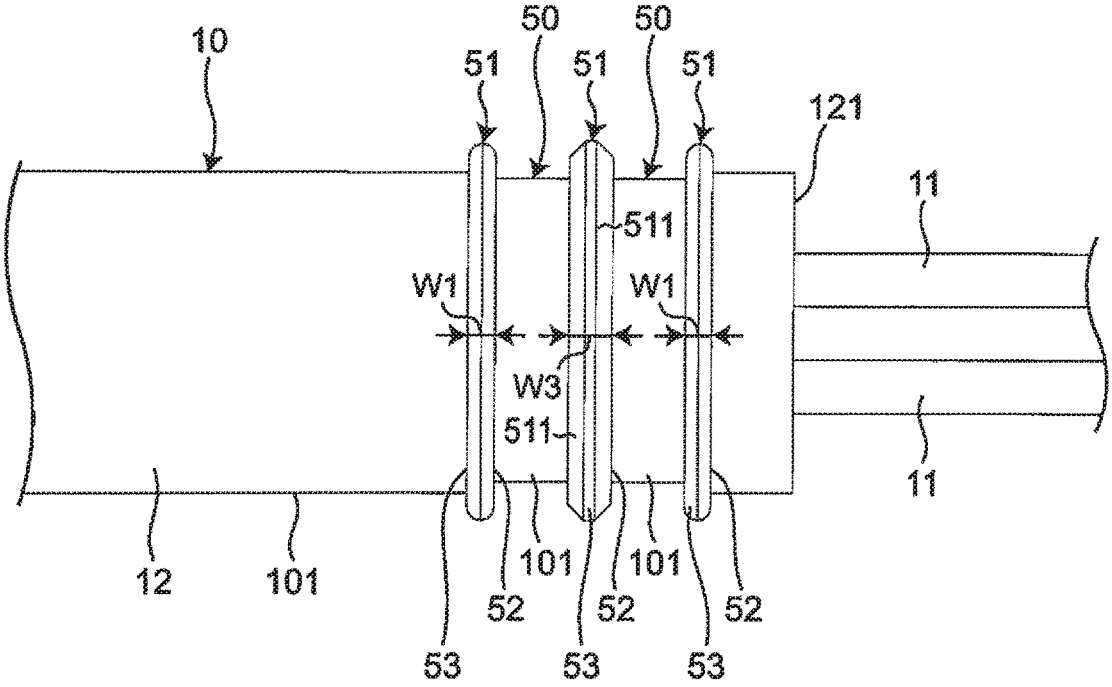
FIG. 6 is a plan view showing the end of the cable for explaining a third modification of the connector in FIG. 1.
Figure 7:
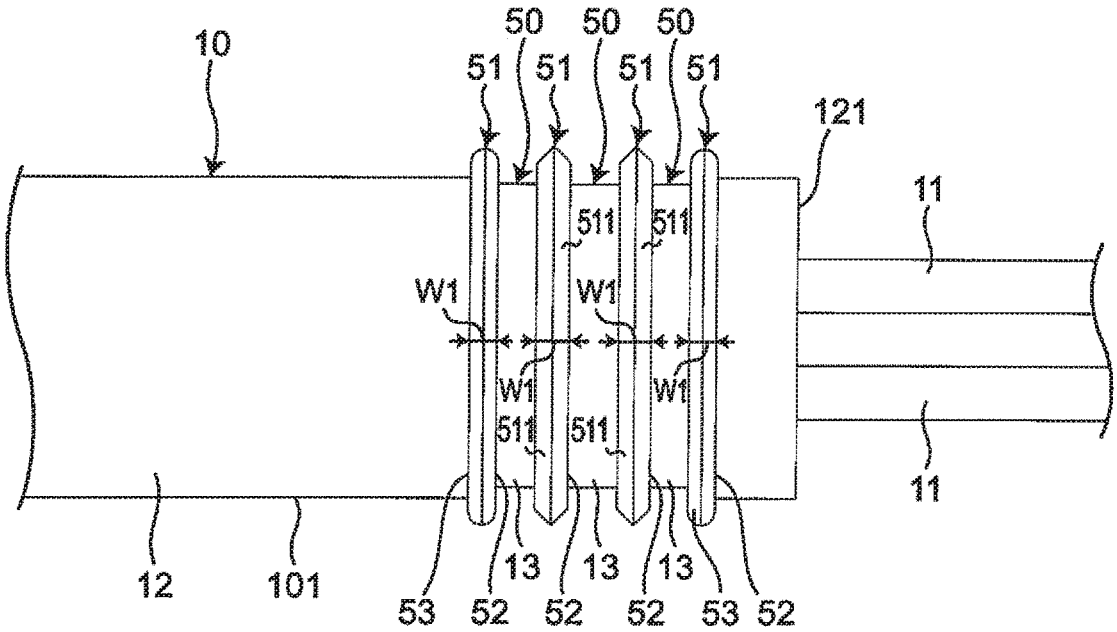
FIG. 7 is a plan view showing the end of the cable for explaining a fourth modification of the connector in FIG. 1.

The number of cohesion units 13 is not limited to one, and a plurality of cohesion units 13 may be provided as shown in FIGS. 6 and 7, for example.

In the cable 10 shown in FIG. 6, two cohesion units 13 are provided which are arranged side by side in the extending direction of the cable 10. The protrusions 51 are provided on both sides of each cohesion unit 13 in the extending direction of the cable 10. The protrusion 51 between the two cohesion units 13 has, on a plane orthogonal to the extending direction of the protrusion 51, a substantially rectangular annular shape in which a corner of the outer tip in the radial direction of the cable 10 is chamfered to form an inclined surface 511, and has a width W3 larger than the width W1 of each of the other two protrusions 51.

Further, the cable 10 of FIG. 7 is provided with three cohesion units 13 arranged side by side in the extending direction of the cable 10. The protrusions 51 are provided on both sides of each cohesion unit 13 in the extending direction of the cable 10. In the cable 10 of FIG. 7, all the protrusions 51 have the same width W1. Further, the protrusion 51 between two adjacent cohesion units 13 has, on a plane orthogonal to the extending direction of the protrusion 51, a substantially rectangular annular shape in which a corner of the outer tip in the radial direction of the cable 10 is chamfered to form an inclined surface 511. Of the two inclined surfaces 511, the inclined surface 511 facing the connector body 20 (i.e., the inclined surface 511 on the right side in FIG. 7) forms the first additional cohesion unit 52, and the inclined surface 511 not facing the connector body 20 (i.e., the inclined surface 511 on the left side in FIG. 7) forms the second additional cohesion unit 53.

Figure 8:
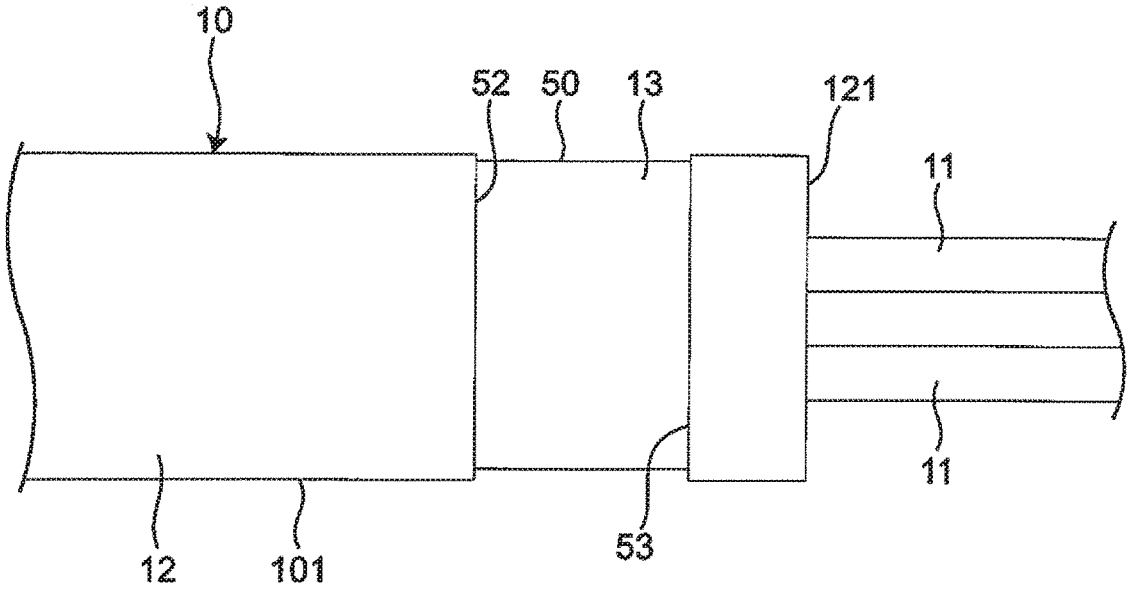
FIG. 8 is a plan view showing the end of the cable for explaining a fifth modification of the connector in FIG. 1.

The protrusion 51 can be omitted as shown in FIG. 8. In this case, the first additional cohesion unit 52 is disposed on the side surface of the recess 50 facing the first connector body 20 (i.e., the side surface farther from the first connector body 20 on the center line CL of the cable 10), and second additional cohesion unit 53 is disposed on the side surface of the recess 50 not facing the first connector body 20 (i.e., the side surface closer to the first connector body 20 on the center line CL of the cable 10).

The depth of the recess 50 (i.e., a linear distance L (shown in FIG. 3) from the surface of the insulation 12 to the bottom surface of the recess 50) can be changed in a freely selectable manner. For example, the recess 50 can be configured such that the surface of the insulation 12 and the bottom surface of the recess 50 are located substantially flush with each other, and the recess 50 may be omitted practically. In this case, the cohesion unit 13 can be formed, for example, by forming fine unevenness on the surface of the insulation 12 instead of the recess 50 and heating the portion where the fine unevenness is formed. For example, when the recess 50 is configured such that the surface of the insulation 12 and the bottom surface of the recess 50 are located substantially flush with each other and the protrusion 51 is omitted, the first additional cohesion unit 52 and the second additional cohesion unit 53 are also omitted. Further, for example, when the recess 50 is configured such that the surface of the insulation 12 and the bottom surface of the recess 50 are located substantially flush with each other and the protrusion 51 is provided, the first additional cohesion unit 52 and the second additional cohesion unit 53 are each provided only on the protrusion 51.

As described above, various aspects of the present disclosure have been described in detail with reference to the drawings, and finally, various aspects of the present disclosure will be described. In the following description, reference numerals will also be provided as examples.

A connector 1 of a first aspect of the present disclosure is provided with: a cable 10 that includes a conductor 11 and an insulation 12 covering the conductor 11; connector bodies 20, 30 that are provided on one ends 101, 102 in an extending direction of the cable 10, and on the inside of which a terminal 22 connected with the conductor 11 of the cable 10 is housed; and a cover unit 40 that covers and integrates each of the one ends 101, 102 of the cable 10 and each of the connector bodies 20, 30. The cable 10 includes a first cohesion unit 13 provided on the surface of the insulation 12 at each of one ends 101, 102 over the entire circumference around the extending direction of the cable 10, and fixed to the cover nit 40 so as to be detachable by cohesive fracture.

According to the connector 1 of the first aspect, the cable 10 includes the first cohesion unit 13 provided on the surface of the insulation 12 at each of one ends 101, 102 of the cable 10 over the entire circumference around the extending direction of the cable 10. In the first cohesion unit 13, the insulation 12 of the cable 10 and the cover unit 40 are fixed so firmly that, when the insulation 12 of the cable 10 and the cover unit 40 are tried to be peeled off, cohesive fracture occurs in the insulation 12 of the cable 10 with respect to the cover unit 40. The first cohesion unit 13 makes it possible to prevent oil from entering the inside of each of the connector bodies 20, 30 through the space between the cable 10 and the cover unit 40 for a long time, and achieve the connector 1 having high oil resistance.

In a connector 1 of a second aspect of the present disclosure, the cable 10 includes a second cohesion unit 52 provided on a surface facing each of the connector bodies 20, 30 and extending in a direction intersecting with the extending direction of the cable 10, and is fixed to the cover unit 40 so as to be detachable by cohesive fracture.

According to the connector 1 of the second aspect, the second cohesion unit 52 makes it possible to prevent oil from entering the inside of each of the connector bodies 20, 30 through the space between the cable 10 and the cover unit 40 for a longer time, and achieve the connector 1 having higher oil resistance.

In a connector 1 of a third aspect of the present disclosure, the cable 10 includes a protrusion 51 extending from the surface of the insulation 12, adjacent to the first cohesion unit 13 in the extending direction of the cable 10, in the direction intersecting the extending direction of the cable 10. The protrusion 51 includes the second cohesion unit 52 disposed on the side surface of the protrusion 51 facing the connector body 20, and a third cohesion unit 53 provided on the surface excluding the side surface of the protrusion 51 facing the connector body 20, and fixed to the cover unit 40 so as to be detachable by cohesive fracture.

According to the connector 1 of the third aspect, by providing the protrusion 51 that includes the second cohesion unit 52 and the third cohesion unit 53, it is possible to prevent oil from entering the inside of each of the connector bodies 20, 30 through the space between the cable 10 and the cover unit 40 for a longer time, and achieve the connector 1 having higher oil resistance.

In a connector 1 of a fourth aspect of the present disclosure, the first cohesion unit 13 is disposed apart from the end 121 of the insulation 12 at each of the one ends 101, 102 of the cable 10 along the extending direction of the cable 10.

According to the connector 1 of the fourth aspect, regardless of the cutting accuracy at the end 121 of the insulation 12 of the cable 10, the first cohesion unit 13 can be accurately disposed at a desired position.

By appropriately combining any of the various embodiments or modifications described above, the effects of the respective embodiments or modifications can be achieved. In addition, a combination of embodiments, a combination of modifications, or a combination of an embodiment and an modification is possible, and a combination of features in different embodiments or examples is also possible.

Although the present disclosure has been fully described in connection with the preferred embodiments with reference to the accompanying drawings, various variations and modifications will be apparent to those skilled in the art. It is to be understood that, so long as not departing from the scope of the present disclosure as set forth in the appended claims, the variations and modifications as thus described are included therein.

INDUSTRIAL APPLICABILITY

The connector of the present disclosure is applicable to, for example, an automobile machine tool.

DESCRIPTION OF REFERENCE SIGNS 1. connector
10. cable
101. first end
102. second end
11. conductor
12. insulation
121. end
13. cohesion unit (example of first cohesion unit)
20. first connector body
21. housing
22. terminal
30. second connector body
40. cover unit
50. recess
51. protrusion
52. first additional cohesion unit (example of second cohesion unit)
53. second additional cohesion unit (example of third cohesion unit)
CL. center line

The invention claimed is:

1. A connector comprising:
a cable that comprises a conductor and an insulation covering the conductor;
a connector body provided on one end of the cable in an extending direction of the cable, on an inside of which a terminal connected with the conductor of the cable is housed; and
a cover unit that covers and integrates of the one end of the cable and the connector body from outside, wherein
the cable comprises a first cohesion unit provided on an outer surface of the insulation at the one end of the cable over an entire circumference around the extending direction of the cable, fixed to an inner surface of the cover unit so as to be detached only by cohesive fracture.

2. The connector according to claim 1, wherein
the cable comprises a second cohesion unit provided on a surface facing the connector body, extending in a direction intersecting with the extending direction of the cable, and is fixed the inner surface of to the cover unit so as to be detached only by cohesive fracture.

3. The connector according to claim 2, wherein
the cable comprises a protrusion extending from the surface of the insulation, adjacent to the first cohesion unit in the extending direction of the cable, in the direction intersecting the extending direction of the cable, and
the protrusion comprises:
the second cohesion unit, disposed on a side surface of the protrusion facing the connector body; and
a third cohesion unit provided on a surface excluding the side surface of the protrusion facing the connector body, fixed to the inner surface of the cover unit so as to be detached only by cohesive fracture.

4. The connector according to claim 1, wherein
the first cohesion unit is disposed apart from an end of the insulation at the one end of the cable along the extending direction of the cable.

* * * * *